US005685231A

United States Patent [19]

Eyre

[11] Patent Number: 5,685,231

[45] Date of Patent: Nov. 11, 1997

[54] COMPUTER WORK STATION

[76] Inventor: Clarence W. Eyre, Rt. 1, Box 374, Dry Prong, La. 71423

[21] Appl. No.: 956,157

[22] Filed: Oct. 5, 1992

[51] Int. Cl.[6] ..... A47F 5/12

[52] U.S. Cl. ..... 108/7; 108/10

[58] Field of Search ..... 108/1, 2, 7, 10, 108/144

[56] References Cited

U.S. PATENT DOCUMENTS

| | | | |
|---|---|---|---|
| 544,836 | 8/1895 | Vetter . | |
| 2,541,075 | 2/1951 | Koch . | |
| 2,822,229 | 2/1958 | Carlson . | |
| 3,364,881 | 1/1968 | Kooi | 108/2 |
| 3,903,812 | 9/1975 | Cowley | 108/2 |
| 3,908,560 | 9/1975 | Horner | 108/2 |
| 4,130,069 | 12/1978 | Evans et al. . | |
| 4,440,096 | 4/1984 | Rice et al. | 108/7 |
| 4,474,115 | 10/1984 | Carlton | 108/7 |
| 4,550,666 | 11/1985 | Svoboda . | |
| 4,567,835 | 2/1986 | Reese et al. | 108/7 |
| 4,637,322 | 1/1987 | Hampshire et al. | 108/7 |
| 4,667,605 | 5/1987 | Bastian . | |
| 4,712,653 | 12/1987 | Franklin et al. . | |
| 4,717,112 | 1/1988 | Pirkle . | |
| 4,751,884 | 6/1988 | Ball . | |
| 4,805,538 | 2/1989 | Fisher et al. | 108/10 |
| 4,815,391 | 3/1989 | Lee | 108/10 |
| 4,826,123 | 5/1989 | Hannah et al. . | |
| 4,938,441 | 7/1990 | Hannah et al. . | |
| 5,041,770 | 8/1991 | Seiler et al. | 108/7 |
| 5,101,736 | 4/1992 | Bommarito et al. | 108/7 |
| 5,131,333 | 7/1992 | Karasawa et al. . | |

FOREIGN PATENT DOCUMENTS

| | | | |
|---|---|---|---|
| 813763 | 5/1969 | Canada | 108/7 |
| 2508294 | 12/1982 | France . | |
| 3347296 | 7/1985 | Germany . | |
| 3701797 | 8/1988 | Germany . | |
| 530491 | 7/1955 | Italy . | |
| 99489 | 11/1923 | Switzerland . | |
| 441653 | 1/1968 | Switzerland | 108/7 |
| 774129 | 5/1957 | United Kingdom . | |

*Primary Examiner*—Michael J. Milano

[57] ABSTRACT

An adjustable computer station has separate platforms for a computer console and a keyboard, the console platform being adjustable between upper and lowermost positions and any position in between with the keyboard platform movable with the console platform and independently movable between upper and lowermost positions and any positions in between and in addition may be tilted between two different positions. The mechanism may be used in any situation in which such adjustability is advantageous.

10 Claims, 3 Drawing Sheets

COMPUTER WORK STATION

The present invention relates to a computer work station and more particularly to a computer work station in which the height and angle of the keyboard platform is variable independently as well as with the height of the computer console and monitor platform which is also variable.

BACKGROUND OF THE INVENTION

There are numerous prior patents and publications setting forth typewriter desks that may be raised and lowered and patents permitting intermediate adjustment of platform height.

U.S. Pat. No. 544,836 uses a counterweight to assist in raising and lowering a typewriter platform. Intermediate positions are not available.

U.S. Pat. No. 2,822,229 provides a front located pull knob to release a typewriter platform so that it may be lowered.

U.S. Pat. No. 4,550,666 provides a screw and nut mechanism that may be used to adjust the height of a platform relative to a fixed platform from which it extends.

U.S. Pat. No. 4,712,653 employs a gas cylinder to assist raising and lowering a platform between only uppermost and lowermost positions.

None of these references provide the ability to raise and lower to any location between top and bottom positions and change the tilt of a first platform attached to a further platform which may also be raised and lowered to any location between top and bottom positions. The references do not provide the flexibility to accommodate people of quite different stature or people some of whom wish to stand, others of whom wish to sit and still others who wish a flat keyboard or a tilted keyboard.

OBJECTS OF THE INVENTION

It is an object of the present invention to provide a highly adjustable computer console that may accommodate people of various stature and desires concerning keyboard angles, the desire to sit or desire to stand, and the height of the keyboard relative to the console and/or monitor.

It is another object of the present invention to provide a valve controlled gas cylinder in retaining a keyboard platform at a lowermost to an uppermost position and all positions in between.

Still another object is to provide a main platform for a computer, which main platform may be raised and lowered between extremes and all positions in between and the support of which supports a keyboard platform that may be raised and lowered relative to the main platform between upper and lower positions and all positions in between and may also be tilted relative to the main platform.

BRIEF DESCRIPTION OF THE PRESENT INVENTION

A main platform for a computer console and/or monitor is supported in vertical guides attached to a base support. The platform is counterweighted to assist movement between upper and lower positions. The counterweight is supported by a chain or the like that passes over a pulley attached to the base support and is attached to main platform whereby as the main platform is moved up and down the counterweight is moved up and down and assists in such movement. The pulley includes a brake mechanism which is normally engaged so that unless the brake is released the platform remains in whatever position it has been put.

A keyboard platform is suspended from supports for the main platform by a suspension which permits up and down movement in which the platform's upper surface remains parallel to itself at any position between upper and lower extremes.

A charged air cylinder is employed to hold the keyboard platform in any position desired as between upper and lower extremes, the piston being valve operated by a control at the front of the keyboard platform to permit movement thereof.

The keyboard platform may be disposed in two angular positions so as to provide a horizontal surface or a surface tilted toward the operator.

The above and other features, objects and advantages of the present invention, together with the best means contemplated by the inventors thereof for carrying out their invention will become more apparent from reading the following description of a preferred embodiment and perusing the associated drawings in which:

DETAILED DESCRIPTION OF THE PRESENT INVENTION

Figure 1:
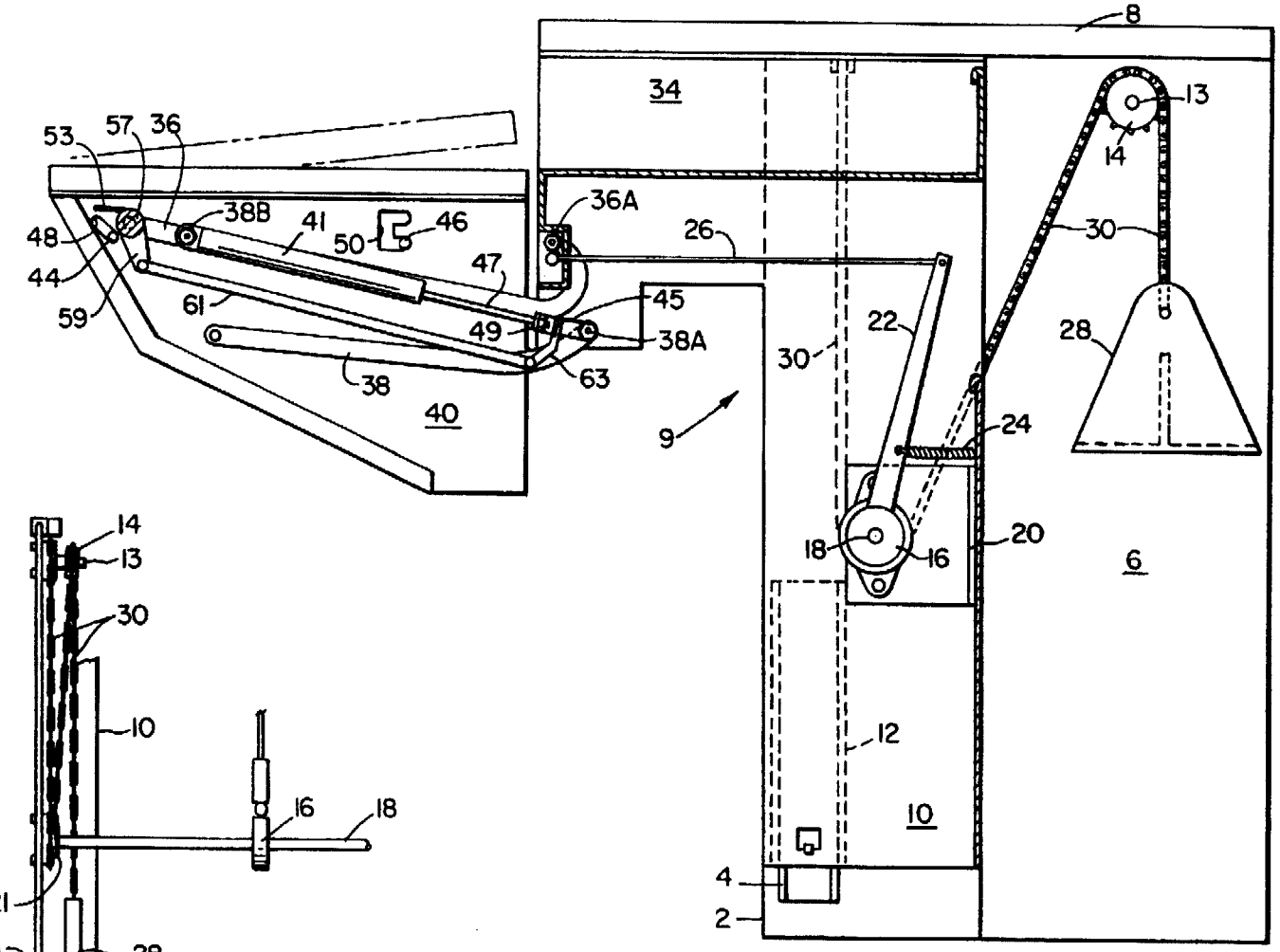
FIG. 1 is a side view in elevation of the computer console and keyboard platforms in a first position.
Figure 3:
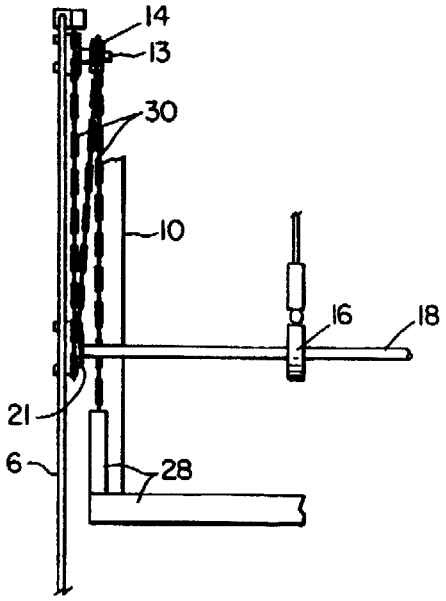
FIG. 3 is a detailed view of the location of the pulley mechanisms and brake for controlling the position of the console platform.
Figure 2:
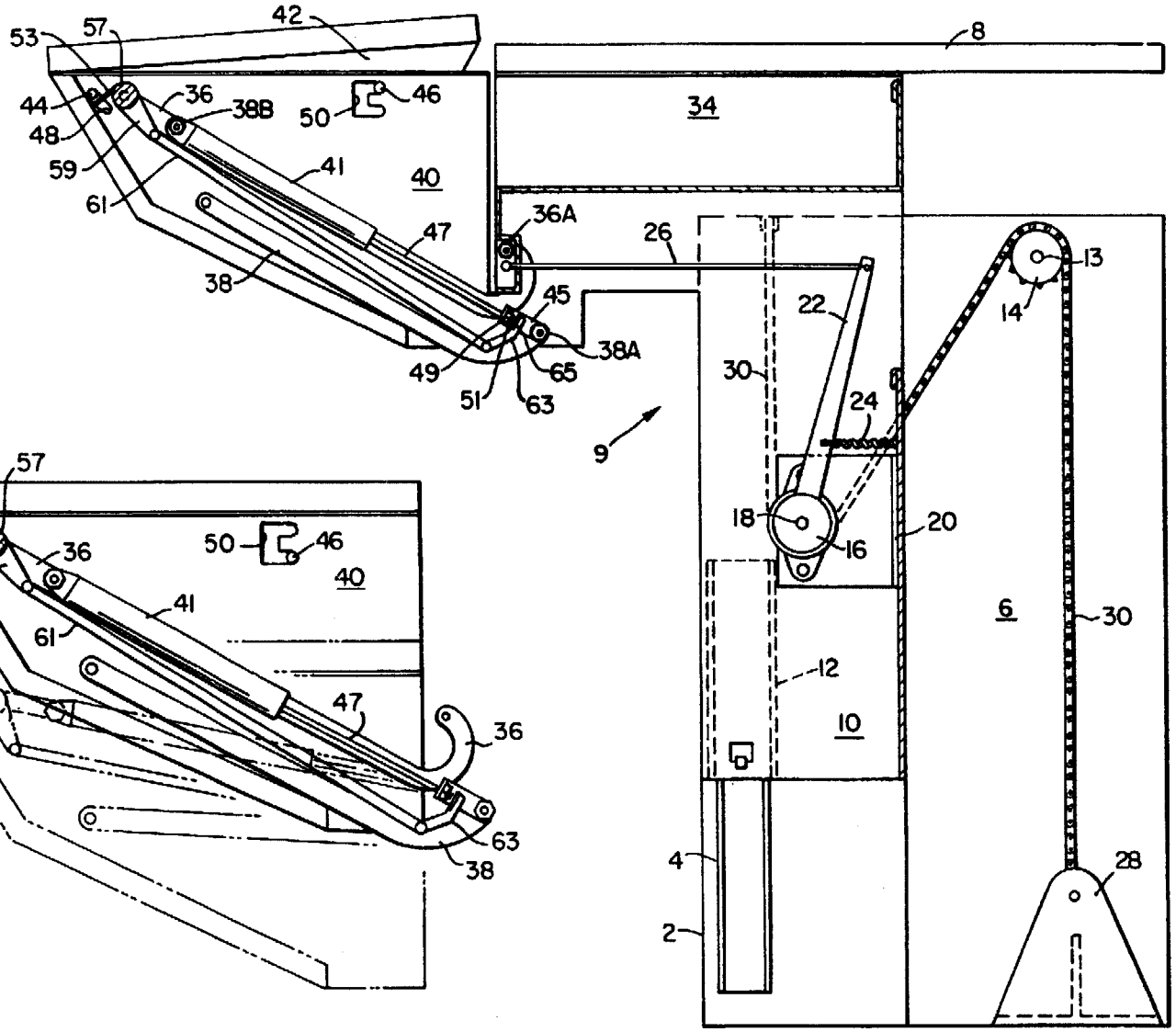
FIG. 2 is a side view in elevation of the computer console and keyboard platforms in a second position.
Figure 5:
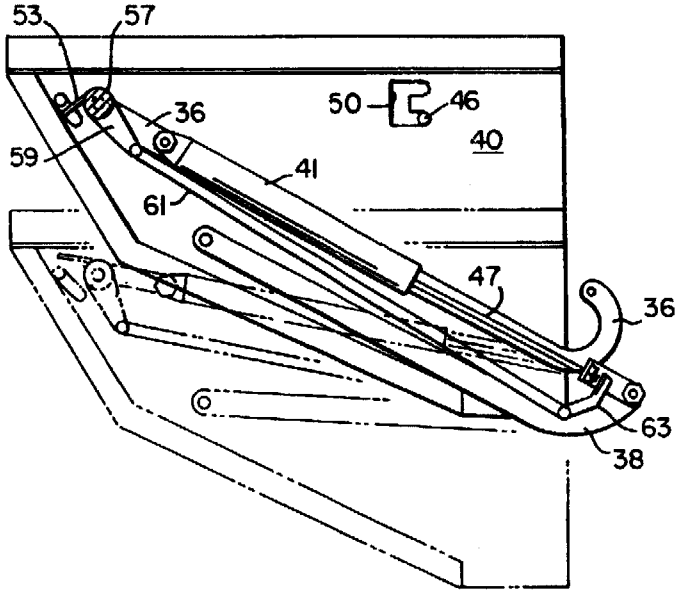
FIG. 5 is a view illustrating the extreme positions, upper and lower, of the linkages controlling the vertical position of the keyboard platform.

Referring now specifically to FIGS. 1–3, the computer work station of the present invention comprises a base member 2 that stands on the floor or other platform. The platform provides vertical rails 4 on both of its sidewalls 6 only one rail and one sidewall being illustrated. An upper platform 8 of a vertically movable upper structure 9 is supported on side members 10 having guides 12 that ride on the rails 4 so that the platform 8 and side members 10 may slide up and down vertically. As can be seen in FIGS. 1 and 2, the rails 4 in cooperation with the guides 12 prevent substantial horizontal movement of the console platform.

An axle 13 is journaled in, extends between sidewalls 6 and has a pulley 14 mounted on each end thereof only one of which is illustrated thereon. A brake mechanism 16 is mounted midway, for instance on axle 18, between the side members 10 parallel to axle 18. The axle 18 is mounted in and extends between and shortly beyond sidewalls 10 and has a pulley 21 (see FIG. 3) mounted on each end of axle 18 between walls 6 and side members 10. The brake mechanism 16 is rendered stationary (non-rotatable) by the brake mounted on shaft 18 and secured to a backwall 20 of the structure 9. The brake has a control handle 22 biased by spring 24, extending between handle 22 and backwall 20 of upper structure 9 to a braking position so that the pulley of mechanism 16 does not rotate with the position of handle 22 illustrated. The brake is released by pulling to the left on rod 26 that extends between the top of the handle 22 and the front (left) wall of the upper structure 9. A counterweight 28 is secured to one end of a cable 30 that extends over pulley 14 around the pulley 21 of mechanism 16 and is attached to the sidewall 6. There is a corresponding cable on the other side of the structure and the counterweight 28 extends between the cables.

When it is desired to raise or lower the structure 9, or more particularly, the platform 8, the rod 26 is pulled to the left, as viewed in FIGS. 1 and 2, releasing the brake and permitting easy movement of the structure 9. To hold the structure 9 in a particular position, the brake is released when the structure has been located in such position.

Figure 4:
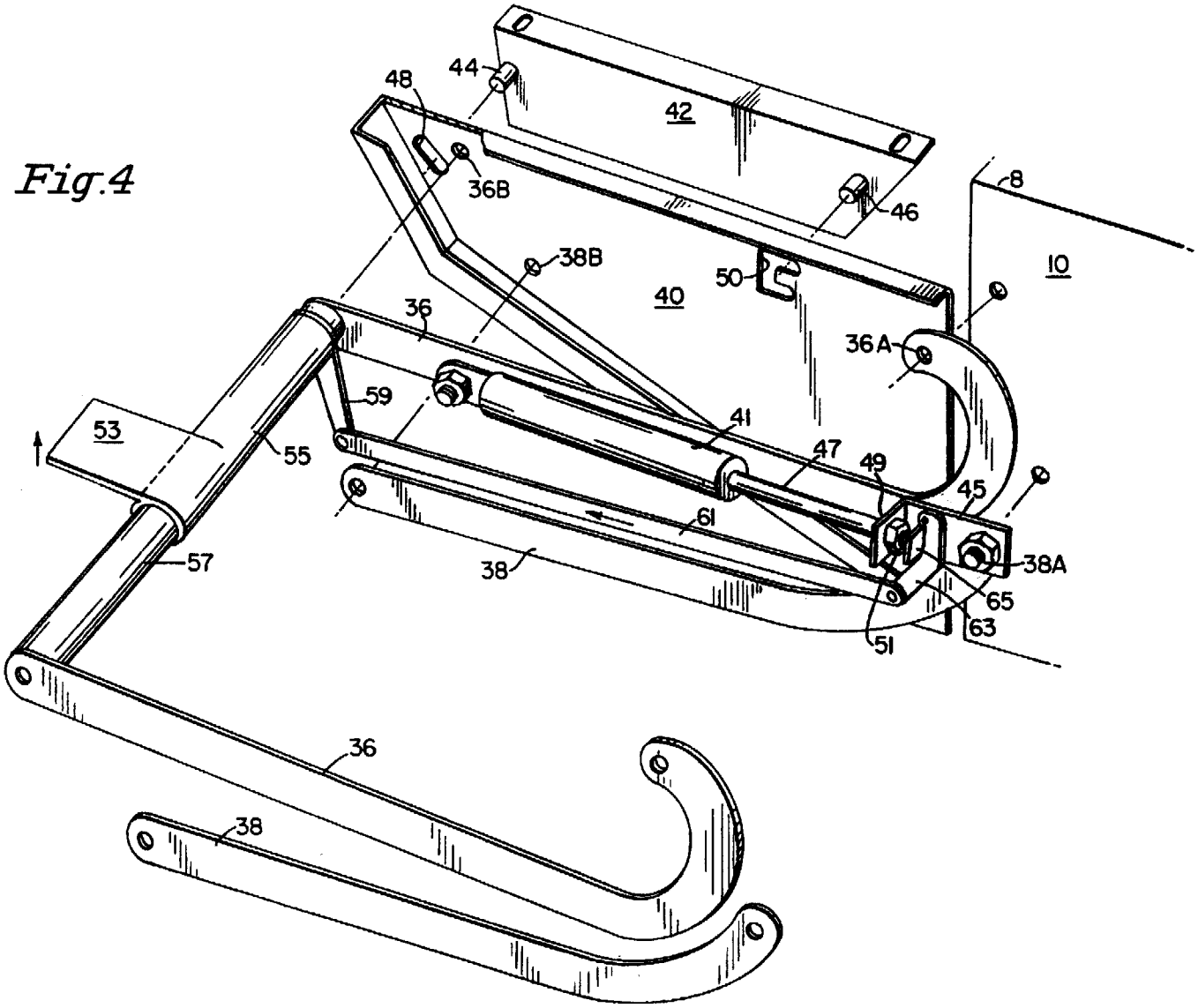
FIG. 4 is a detailed view in perspective of the mechanisms for controlling the positionings of the keyboard platform.

Referring now to FIGS. 1, 2 and 4 of the accompanying drawings, a keyboard platform 32 is suspended from the side members 10 of a forward extension 34 (left as seen in FIGS. 1 and 2) of the upper structure 9. A pair of arms 36 and 38 (one pair on each side of the platform 32) are pivoted at one end in side members 10, the upper arms 36 as viewed in FIG. 4 having a curved end that has about a 180° arc and a pivot 36A at about the end of the arc. Lower arms 38 have a slight curve and are pivoted at 38A to side members 10 below and to the right of the pivot 36A of arm 36. The other ends of arms 36 and 38 are pivoted at 36B and 38B to side plates 40 that are suspended from frame members 42 parallel to the plates 40. The frame members 42 are connected to the underside of keyboard platform 32.

A piston 41 extends between arms 36 and 38 with the cylinder of the piston pivoted to arm 36 near pivot 36B of arm 36, to an L-shaped plate 43 positioned with the long leg 45 of the plate 43 parallel to and secured to the arm 38. A piston rod 47 of the piston 41 is secured in the short leg 49 of L-shaped plate 43. The leg 49 of plate 43 is perpendicular to arm 38 and plate 45 is pivoted along with arm 38 at 38A. A valve control pin 51 extends through leg 49 and controls a valve (not illustrated) internal of the piston 41. When the valve is closed the piston rod 47 is locked in position so that the arms 36 and 38 cannot be moved relative to one another and the platform 32 is locked in whatever position it was last placed. When it is desired to raise or lower the platform 32, the pin 51 is depressed, by a mechanism to be described, and the piston rod 47 may be moved so that the platform 32 may be moved up and down.

The mechanism for depressing the pin 51 includes a release handle 53 secured to a sleeve 55 rotatable about a shaft 57 that extends between the ends of the two arms 36. A link 59 is rotatable with sleeve 55 and extends between the end of sleeve 55 and a further link 61 to which it is pivotally secured. The link 61 extends generally parallel to lower arm 38 and is pivoted to a dogleg link 63 at the latter's lower end as viewed in FIG. 4. The upper end of link 63 is pivoted to the long leg 45 of the L-shaped member 43 and has secured thereto a plate 65 opposed to the piston control pin 51.

When the release handle 53 is raised, sleeve 55 is rotated and the lower end of link 59 moves to the left as viewed in FIG. 4. Thus the lower end of link 61 also moves to the left, plate 65 depresses pin 51 and the piston rod 47 is slidable in the cylinder 41.

The piston mechanism is gas pressured and is available from Stabilus GmbH, D-5400 Koblenz Herberichstr. 47–53, Postfach 2029 Germany, under various trademarks including Bloc-O-Lift, a U.S. trademark registration.

The frame members 42 have pins or posts 44 and 46, extending perpendicular to the plane of the members 40 and 42. The post 44 extends into slots 48 in side plates 40 that permit the frame member 42 to be moved forward and backwards relative to the platform 32, i.e., relative to the side plates 40. These posts 44 permit the platform 32 to be rotated about the posts 44 to change the angle (tilt) of the platform relative to the floor. The degree to which the platform may be tilted is determined by the posts 46 seated in block C-shaped slots 50 formed in the side plates 40. The posts are viewed in FIGS. 1 and 2 show the platform horizontal and tilted, respectively. To change the tilt, the platform 32 is pulled forward so that the posts 46 are located in the vertical channels of the slots 50. The platform may now be pivoted about the posts 44 so that the back of the platform may be raised or lowered and then pushed back so that the posts 46 are seated in the lower or upper horizontal members of the slots 50 as seen in FIGS. 1 and 2, respectively. The slots 50 being C-shaped provide only two positions. They may be E-shaped for 3 positions or still additional transverse slots may be provided to provide still other angles of tilt.

It is noted that since the platform 32 is suspended from the sidewalls 10 of the vertically movable support for platform 8, the platform 32 moves with platform 8 so that the relative locations of these platforms remains the same upon movement of platform 5 unless the location of platform 32 is deliberately changed.

In order to move the console platform, it is necessary to drop the keyboard platform 32 to about its lowest position in order to gain access to the end of the control rod in order to release the brake 16.

Once given the disclosure, many other features, modifications and improvements will become apparent to the skilled artisan. Such other modifications, features and improvements are, therefore, considered a part of this invention, the scope of which is to be determined by the following claims.

What is claimed is:

1. An adjustable computer station comprising a console platform for supporting a computer system component, a keyboard platform for supporting a keyboard, a first mechanism for vertically adjusting the height of said platforms to any position between uppermost and lowermost positions, and a second mechanism for adjusting the height of the entire keyboard platform relative to the console platform between uppermost and lowermost positions, said first mechanism including a braking mechanism for permitting movement of said platforms from a selected position only upon release of said braking mechanism, said second mechanism including a base member for vertically supporting a structure supporting said console platform, said structure and said base member having sidewalls with vertical guides and vertical rails permitting vertical movement of the structure relative to said base member.

2. An adjustable computer station according to claim 1 further comprising a third mechanism for adjusting the angle of the keyboard platform relative to the horizontal.

3. An adjustable computer station according to claim 1 or claim 2 wherein said first mechanism retains said console platform at said uppermost and lowermost positions and any position in between.

4. An adjustable computer station comprising a console platform for supporting a computer system component, a keyboard platform for supporting a keyboard, a first mechanism for vertically adjusting the height of said platform to any position between uppermost and lowermost positions, and a second mechanism for adjusting the height of the entire keyboard platform relative to the console platform between uppermost and lowermost positions, said first mechanism including a braking mechanism for permitting movement of said platforms from a selected position only upon release of said braking mechanism, said second mechanism including a base member for vertically supporting a structure supporting said console platform, a structure having sidewalls supporting said console platform, said structure and said base member having sidewalls with vertical guides and vertical rails permitting vertical movement of the structure relative to said base member, a first pair of side members supporting said keyboard platform, a second pair of side members, two pairs of upper and a lower arms extending between a different one of said sidewall and a different one of said second side members, said second side members pivotally secured to said first side members, said arms being pivoted to their adjacent sidewalls and side members to permit vertical movement of said keyboard platform relative to said sidewalls.

5. An adjustable computer station according to claim 4 further comprising a cylinder and piston member extending between one of said upper arms and one of said lower arms for releasably locking the positions of said upper and lower arms relative to one another.

6. An adjustable computer station according to claim 5 further comprising a further mechanism for releasing said cylinder-piston member from its locked position whereby to permit vertical movement of said keyboard platform.

7. An adjustable computer station according to claim 4 further comprising a connection between said first and second side members such that upon rotation of said first side member relative to said second side member, said first side member may be retained in at least two different ones of said rotated positions.

8. An adjustable computer station according to claim 4 wherein said arms are pivotally secured to said first pair of side members below and adjacent to the end of the console platform adjacent to said keyboard platform whereby said keyboard platform may be raised above the level of said console platform.

9. An adjustable computer station comprising, a console platform for supporting a computer system component, a keyboard platform for supporting a keyboard, a first mechanism for vertically adjusting the height of said platform to any position between uppermost and lowermost positions, said first mechanism comprising a base member for vertically adjustably supporting a structure supporting said console platform, said first mechanism including a braking mechanism, said first mechanism further comprising first and second pulleys, cables and a counterweight, a horizontal shaft having said first pulley, and said braking mechanism mounted thereon, said shaft mounted on said structure, said second pulley mounted rotatably on said sidewall of said base, a cable extending from and secured to a sidewall of said base, extending around said first pulley, over said second pulley and thence to said counterweight whereby upon release of said braking mechanism said structure may be moved up and down, a second mechanism for adjusting the height of the keyboard platform relative to the console platform between uppermost and lowermost positions.

10. An adjustable computer station comprising a console platform for supporting a computer system component, a keyboard platform for supporting a keyboard, a first mechanism for vertically adjusting the height of said platform to any position between uppermost and lowermost positions, said first mechanism including a braking mechanism for maintaining the console platform in any desired position, said first mechanism comprises a base member, side walls and a back wall secured to said base member and extending upwardly therefrom, a pair of rails, each secured to a different side wall, a pair of side members each slidable in a different one of said rails and secured to said console platform for vertical movement therewith, a shaft, a rotatable means pivotally secured on said shaft and supported from said back member, a first pulley secured to said shaft, a second pulley pivotally secured to said side walls, a counterweight, a cable extending from said counterweight in series around said second pulley and thence around said first pulley and to said console platform, a brake for releasably restraining the rotation of said rotatable means, whereby to alternatively prevent and permit vertical movement of said platform, a second mechanism for adjusting the height of the keyboard platform relative to the console platform between uppermost and lowermost positions.

* * * * *